US006009717A

United States Patent [19]

Hernandez et al.

[11] Patent Number: 6,009,717

[45] Date of Patent: Jan. 4, 2000

[54] CONTROL BOX FOR A ROOM AIR CONDITIONER

[75] Inventors: Nestor Hernandez, Mirador Residencial Monterrey; David Hernandez, Monterrey, both of Mexico

[73] Assignee: Carrier Corporation, Syracuse, N.Y.

[21] Appl. No.: 09/140,489

[22] Filed: Aug. 26, 1998

[51] Int. Cl.[7] ..... F25D 23/12

[52] U.S. Cl. ..... 62/262; 62/298

[58] Field of Search ..... 62/262, 298

[56] References Cited

U.S. PATENT DOCUMENTS

| | | | |
|---|---|---|---|
| 4,835,981 | 6/1989 | Rinholen | 62/229 |
| 5,027,614 | 7/1991 | Mori et al. | 62/262 |
| 5,094,089 | 3/1992 | Lail | 62/429 |
| 5,125,239 | 6/1992 | Kobayashi et al. | 62/262 |
| 5,140,830 | 8/1992 | Sawyer | 62/298 |
| 5,237,826 | 8/1993 | Baldwin et al. | 62/77 |
| 5,775,112 | 7/1998 | Wilson | 62/77 |

*Primary Examiner*—Henry Bennett
*Assistant Examiner*—Mark Shulman

[57] ABSTRACT

A control box for an air conditioning unit, which is configured to contain control components and a capacitor. The control box includes a housing having an inverted L-shape, which defines a substantially vertical section and a substantially horizontal section. The horizontal section has an open front defined by peripherally extending edges. One or more of the edges are provided with attachment structure integrally formed thereon. A control panel section for housing the control components has an open back defined by a plurality of peripherally extending edges. The edges of the control panel section are configured to engage the edges of the horizontal section and are provided with attachment structure formed thereon which is configured to cooperate with the attachment structure of the horizontal section to thereby facilitate attachment of the control panel to the horizontal section.

5 Claims, 10 Drawing Sheets

CONTROL BOX FOR A ROOM AIR CONDITIONER

BACKGROUND OF THE INVENTION

The present invention is directed to air conditioners and, more particularly, to a control box for a room air conditioning unit.

Air conditioning units such as so-called "window room air conditioners" are commonly used for residential and similar applications and generally include closed refrigeration circuits having an evaporator and a condenser. The unit is normally divided by a partition into an evaporator section and a condenser section. The evaporator section communicates with the room air to be conditioned and the condenser section communicates with external air such as outdoor air. Refrigerant flows through a refrigerant circuit absorbing heat from room air at the evaporator and discharging heat energy to the external air at the condenser. The conventional refrigeration circuit is completed by the addition of a compressor, an expansion device, and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil, which is mounted vertically in the back of the outdoor section.

The indoor grille also includes an opening therein for the control panel upon which are mounted control knobs, buttons, switches, and the like for facilitating adjustment of the air conditioning unit's function and temperature output. The control panel and the control components associated therewith are typically mounted to a control box for the unit in which are housed other components associated with the electrical system of the air conditioning unit.

Because it is considered desirable to make an air conditioning unit of a given cooling capacity as compact as possible, it is also considered desirable to optimize the use of the available space in the indoor section of an air conditioner.

SUMMARY OF THE INVENTION

A control box for an air conditioning unit, which is configured to contain control components and a capacitor. The control box includes a housing having an inverted L-shape, which defines a substantially vertical section and a substantially horizontal section. The horizontal section has an open front defined by peripherally extending edges. One or more of the edges are provided with attachment structure integrally formed thereon. A control panel section for housing the control components has an open back defined by a plurality of peripherally extending edges. The edges of the control panel section are configured to engage the edges of the horizontal section and are provided with attachment structure formed thereon which is configured to cooperate with the attachment structure of the horizontal section to thereby facilitate attachment of the control panel to the horizontal section.

The control panel section may be configured to house electromechanical or electronic controls. Different control panel sections are readily interchangeable with the basic control box housing. The vertical section of the housing is adapted to lie behind the air conditioning unit's evaporator section while the horizontal section is adapted to extend over the unit's evaporator when installed in an air conditioning unit.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
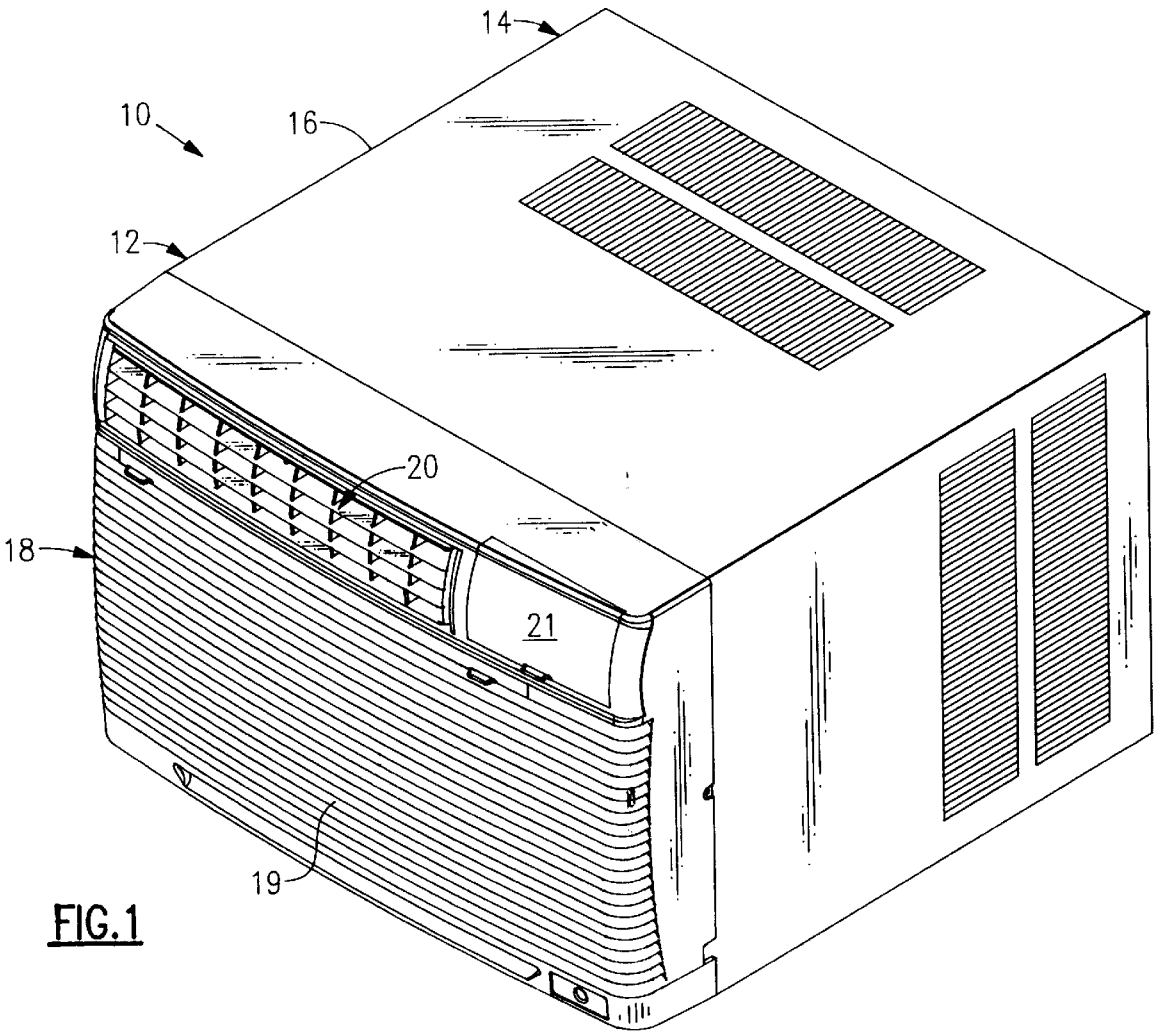
FIG. 1 is a perspective view of a room air conditioner, which embodies the features of this invention.

FIG. 1 illustrates an air conditioner unit 10 which includes generally an indoor section 12 and an outdoor section 14. The room air conditioner is enclosed in a substantially rectangular housing 16 and is adapted to be positioned in a rectangular opening in an exterior or in a window in a room where cooling is desired, with the indoor section 12 facing into the room, as is conventional. The indoor section 12 includes an indoor grille section 18, which includes inlet louvers 19 and an air discharge assembly 20. The front grille 18 also includes a door 21 in the upper right-hand corner, which covers a control panel for the unit as will now be described in more detail.

Figure 2:
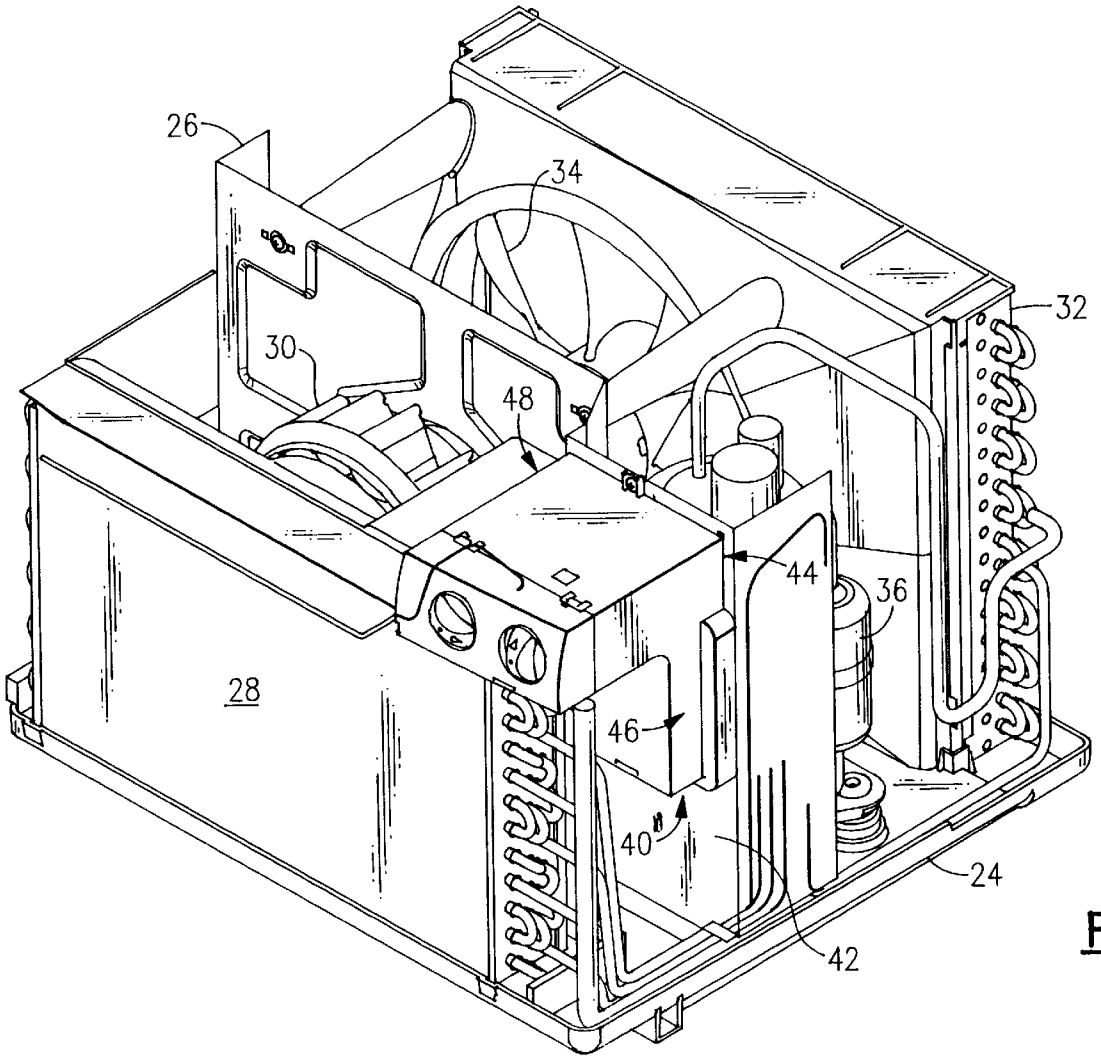
FIG. 2 is a perspective view of the air conditioning unit of FIG. 1 with the outer cover and front grille removed therefrom.

Looking now at FIG. 2, the components of both the indoor section 12 and outdoor section 14 are supported in a rectangular basepan 24. The indoor and outdoor sections are separated by a vertically extending metal partition 26, which is illustrated in more detail in FIGS. 3, 4 and 9. The indoor section includes an evaporator coil 28 vertically disposed at the front end thereof and an evaporator or indoor fan 30 located behind the evaporator 28.

The outdoor section 14 includes a condenser coil 32 vertically disposed adjacent the back end thereof and a condenser fan 34 located within the indoor section adjacent the condenser coil. The unit's compressor 36 is also located in the outdoor section 14. The condenser coil 32 is fluidly interconnected with the compressor 36 and the evaporator 28 in a conventional manner to provide cooling to the room in which the unit is installed.

During operation, air from the space to be conditioned by the unit is drawn by action of the evaporator fan 30 through the inlet louvers 19 and is directed through the evaporator coil 28 where the air is cooled. The cooled air is then directed back into the room to be cooled through the air discharge assembly 20. At the same time, ambient air is drawn through inlets 38 in the outside section of the housing 16 by operation of the condenser fan 34 and is directed through the condenser coil 32 before exiting from the backside of the condenser coil.

As best seen in FIG. 2, the control panel forms a part of a control box 40, which is attached to a planar section 42 of the metal partition 26. The control box 40 basically comprises a main housing 44 having an inverted L-shape. As will be seen, the housing 44 comprises a vertically extending section 46 located behind the evaporator coil 28 and a horizontally extending section 48, which extends partially in overlying relationship with the evaporator coil.

Figure 6:
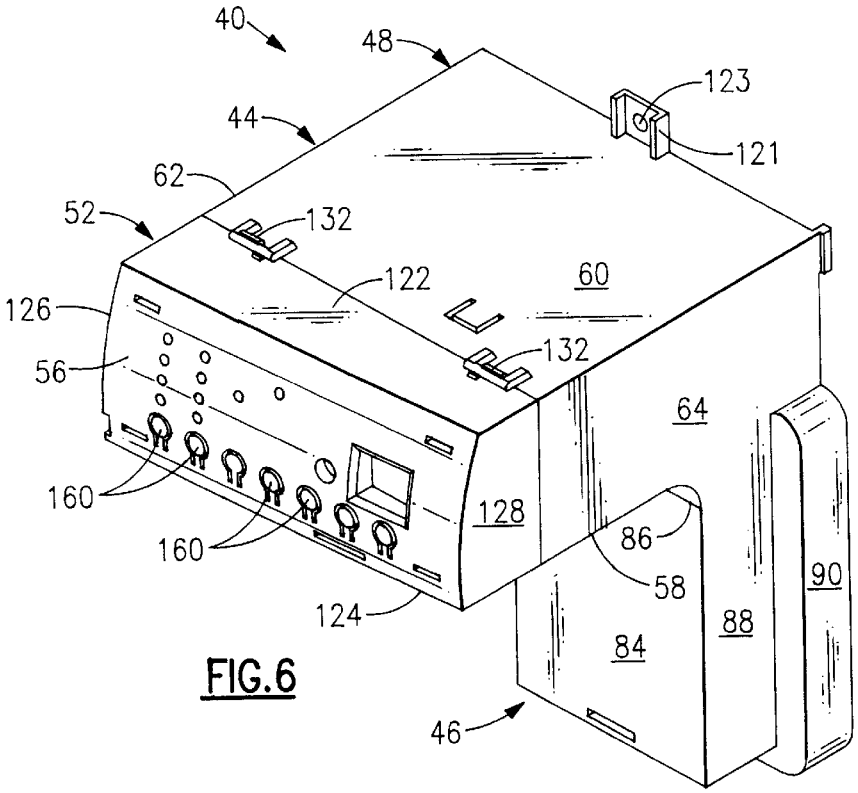
FIG. 6 is an enlarged perspective view of a electronic version of the control box of the present invention.
Figure 7:
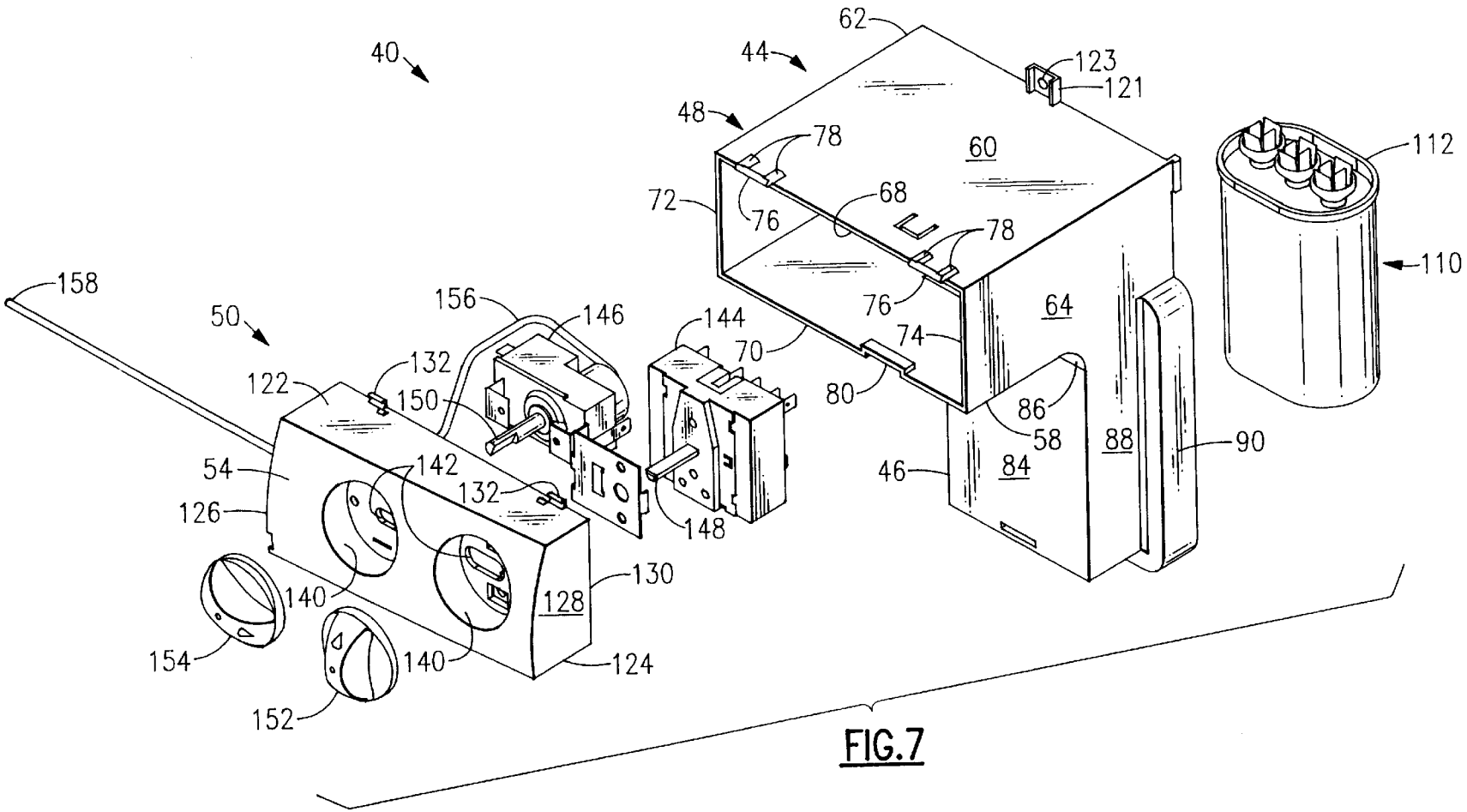
FIG. 7 is an exploded view of the control box illustrated in FIG. 5.
Figure 8:
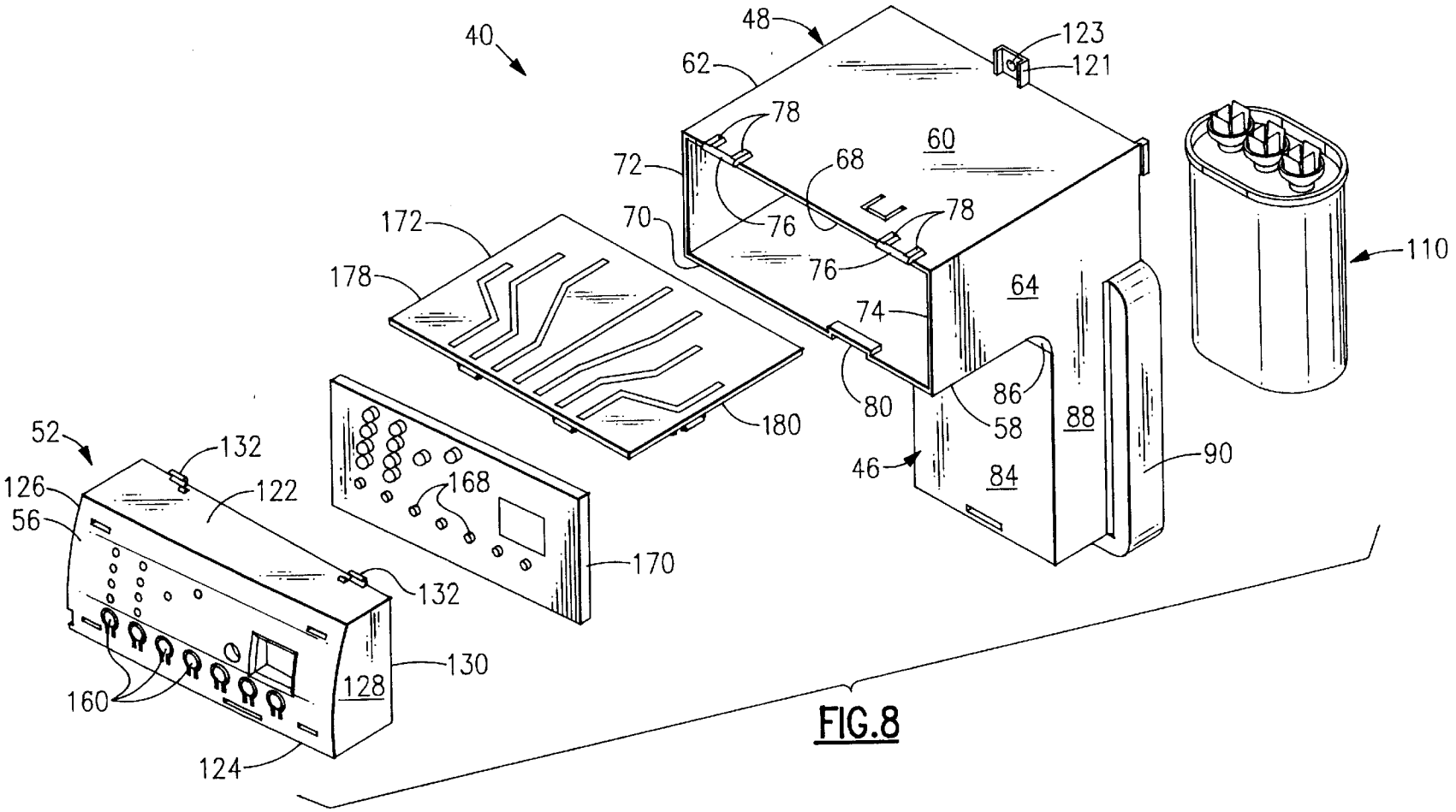
FIG. 8 is an exploded view of the control box illustrated in FIG. 6.
Figure 9:
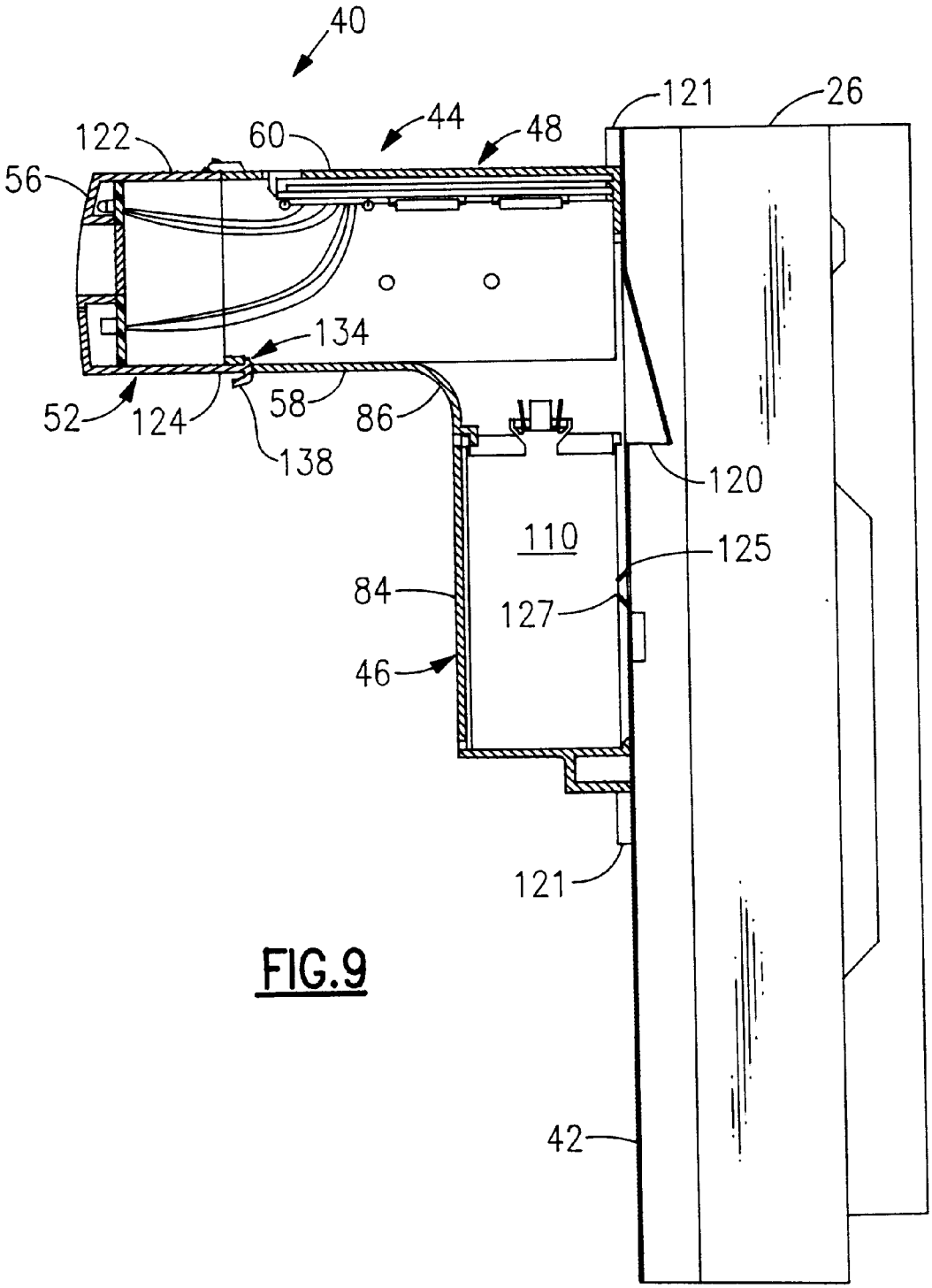
FIG. 9 is a sectional view similar to FIG. 4 of an electronic version of the control box.

The control box 40 is illustrated in two different embodiments, an electromechanical embodiment as illustrated in FIGS. 2–5, 7, 10 and 11, and an electronic embodiment illustrated in FIGS. 6, 8 and 9. The control box housing 44 is identical for both the electromechanical and electronic embodiments. Also, the housing 50 for the electromechanical control panel and the housing 52 for the electronic control panel are structurally identical in terms of their cooperation with the control box housing 44 and differ only in the configuration of their front walls 54 and 56, as will be described in more detail hereinbelow.

Looking now at the control box housing 44, the horizontally extending section 48 comprises a substantially rectangular box defined by a bottom wall 58, a top wall 60, left and right side walls 62 and 64, respectively, and a partially open back wall 66. The front edges 68 of the top wall, 70 of the bottom wall and 72 and 74 of the left and right side walls cooperate to define the open front of the horizontal section 48.

Figure 11:
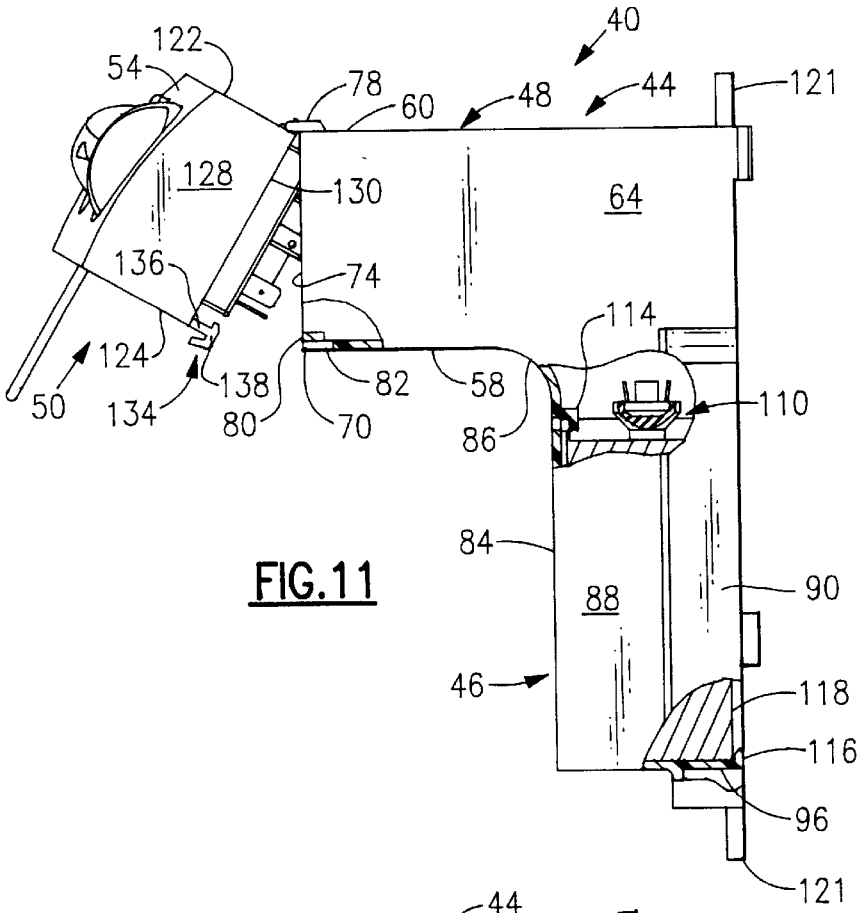
FIG. 11 is a right-side view of the control box of FIG. 5 with the control panel partially disassembled therefrom and partially broken away to show details of attachment structure.

Integrally formed with the front end of the top wall 60 are a pair of spaced apart horizontally extending hinge pins 76. The pins are each supported in forwardly spaced parallel relationship with the front edge 68 of the wall 60 by a pair of forwardly extending pin supports 78. As best seen in FIGS. 7, 8 and 11, the bottom wall 58 of the housing section 48 is provided with a horizontally extending latch bar 80, which is spaced upwardly from the plane of the wall 58. A horizontally extending slot is provided in the bottom wall 58, rearwardly of the latch bar 80 (best seen in FIG. 11).

Figure 13:
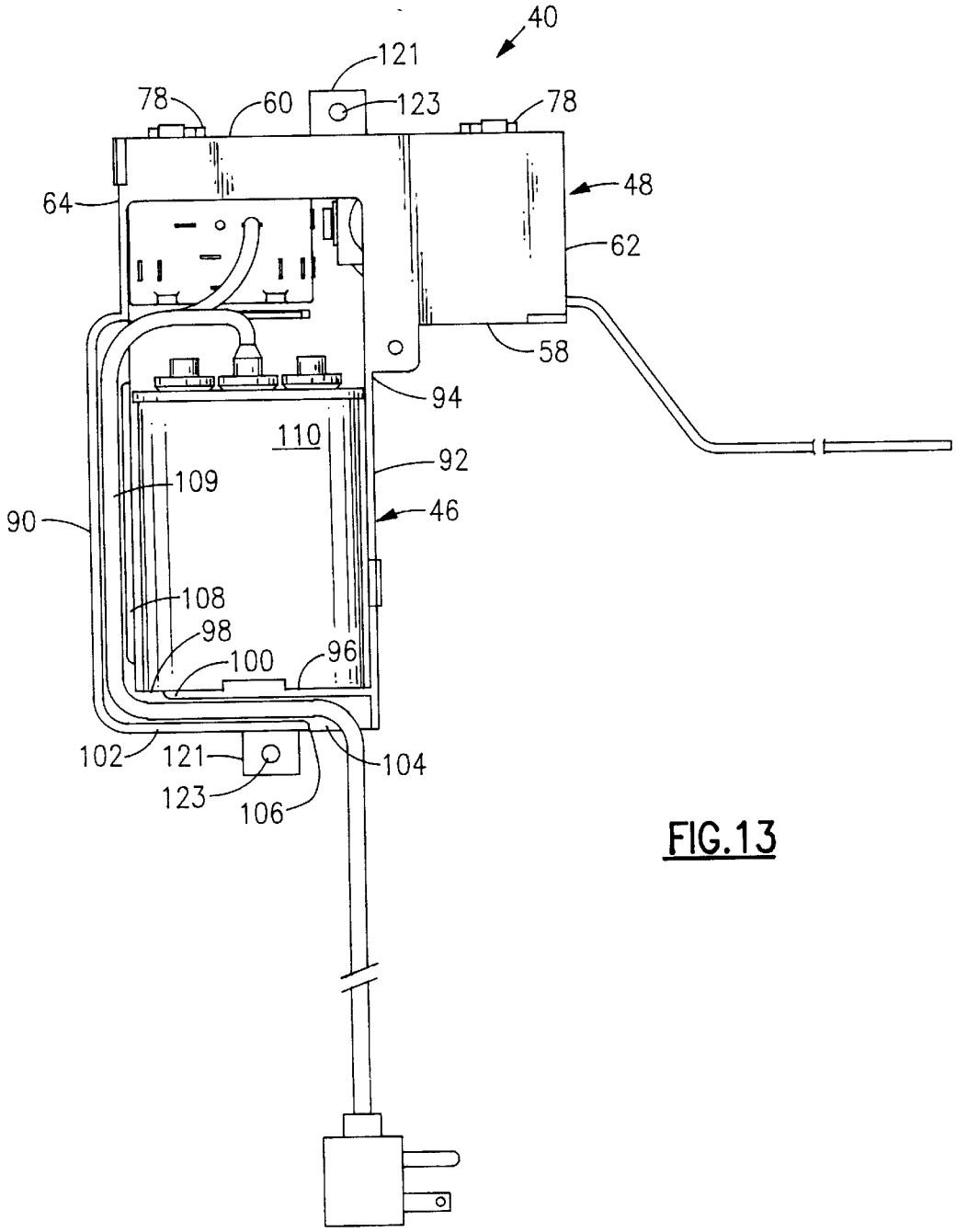
FIG. 13 is a rear view of the control box of FIG. 5.

The vertically extending section 46 of the control box housing 44 is integrally formed with the horizontal section 48. The vertical section is substantially narrower than the horizontal section, as best seen in FIG. 13. The vertical section comprises a vertically extending front wall 84, which is interconnected to the bottom wall 58 of the horizontal section by a curved wall section 86. A right-hand wall 88 is integrally formed with and coplanar with the right-hand side wall 64 of the horizontal section 48, and has an outward extension 90 at the rear thereof, which forms a part of the power cord strain relief path. The left-hand side wall 92, as best seen in FIG. 13, extends downwardly from its intersection 94 with the bottom wall 58 of the horizontal section.

Figure 12:
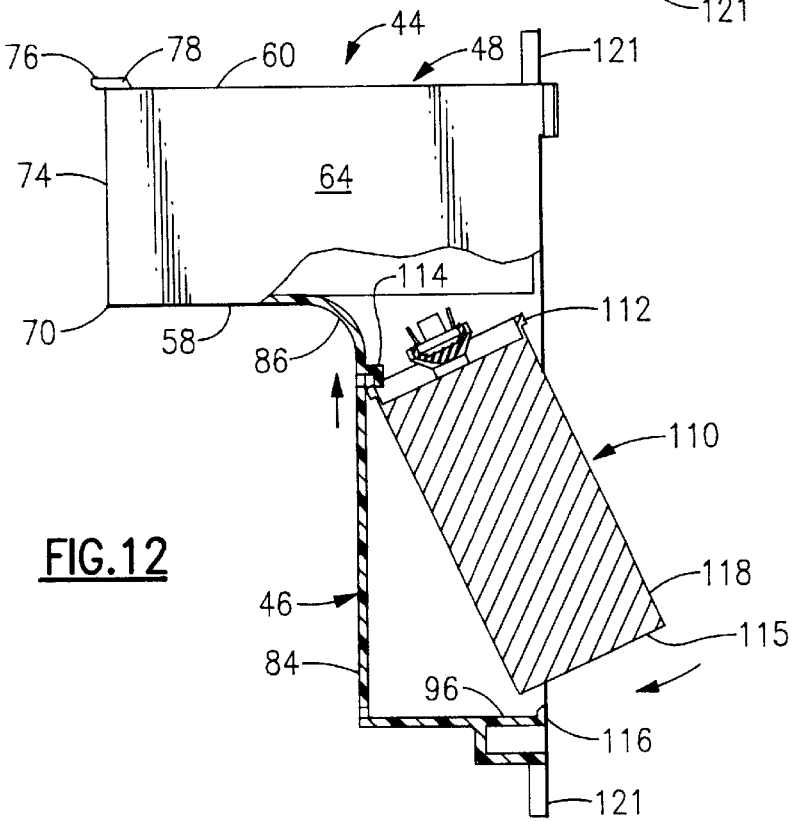
FIG. 12 is a view similar to FIG. 11 with the side broken away to show details of installation of the capacitor therein.

The bottom of the vertical section 46 includes a first inner wall section 96. As best seen in FIGS. 12 and 13, the inner wall has a discontinuity 98 at the left rear end thereof 100, as viewed in FIG. 13. Again, as best seen in FIGS. 12 and 13, a horizontal outer wall 102 extends perpendicular to and is contiguous with the strain relief section 90. The outer wall 102 has a discontinuity 104 at its right end 106 thereof (as viewed in FIG. 13). Again, as best seen in FIG. 13, a vertically extending wall section 108 extends parallel to and in spaced relationship to the strain relief section 90 of the side wall 88. Accordingly, as seen in FIG. 13, the strain relief section 90, the vertical wall 108, the horizontal wall 102, and the discontinuity 104 together define the strain relief path for the power cord 110 of the air conditioning unit.

Also contained in the vertical section 48 of the housing is a large capacitor 110 associated with the electric motors of both the fans and the compressor. The capacitor 110 is of the electrolytic type and has an outer metal casing, which must be grounded. With reference to FIGS. 11 and 12, installation of the capacitor 110 is accomplished by inserting a peripherally extending lip 112 on the upper end of the capacitor under a retaining protrusion 114 formed in the inside surface of the upper end of the front wall 84 of the vertical section. Following such engagement (as illustrated in FIG. 12) the lower end of the capacitor is rotated into the housing until the bottom 115 engages the top of an upstanding lug 116. The lug 116 is formed on the front edge of the bottom wall section 96. Because the wall is not fixed at its discontinuous end 100, the contact of the capacitor causes flexing of the wall and the lug downwardly until the capacitor moves into its installed position, as illustrated in FIGS. 11 and 13, with the lug 116 engaging the back side 118 of the capacitor thereby positively retaining the capacitor in place.

Figure 3:
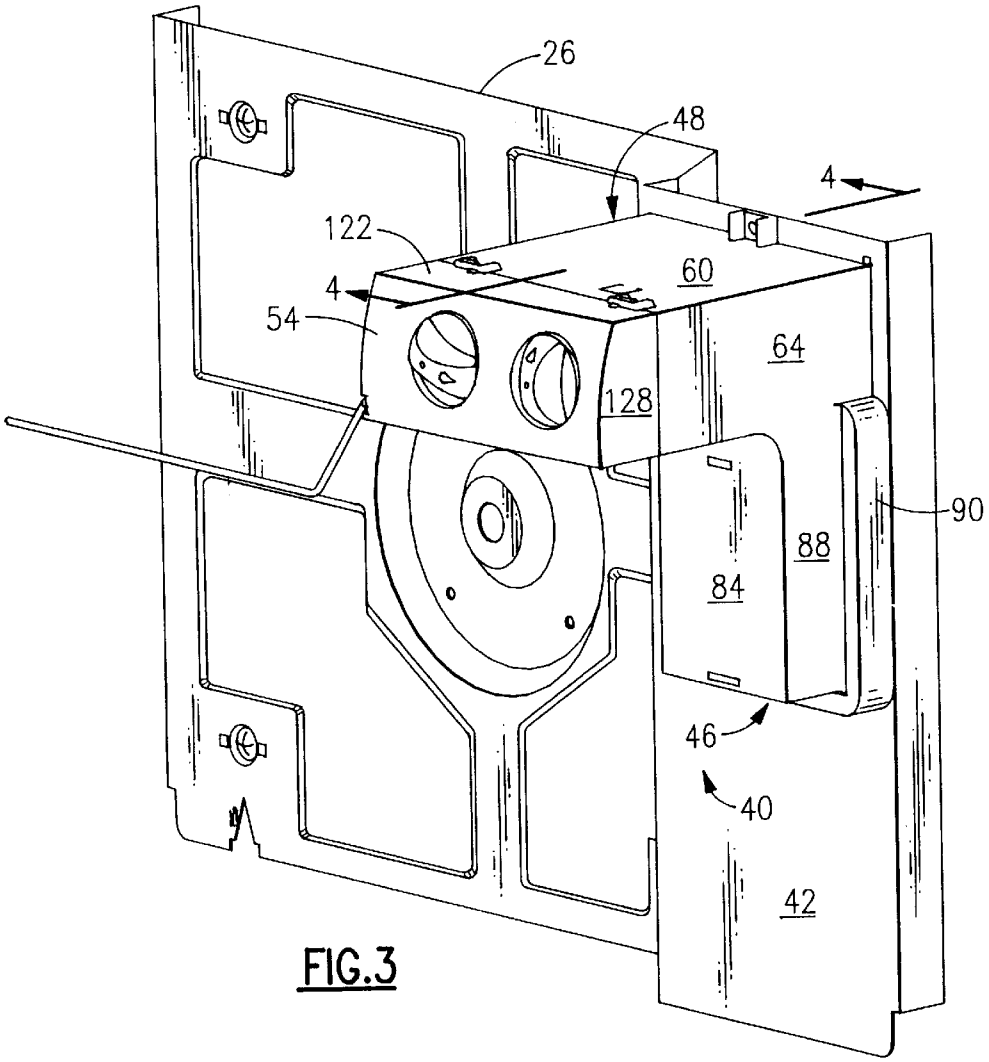
FIG. 3 is an enlarged perspective view of the control box and mounting partition of the air conditioning unit, as illustrated in FIG. 2.
Figure 4:
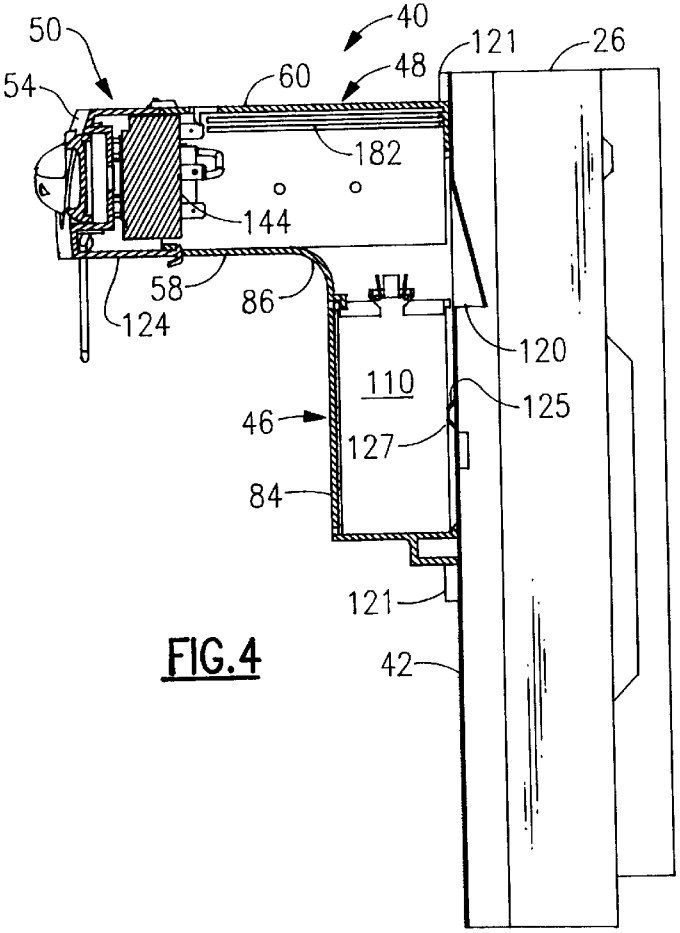
FIG. 4 is a sectional view taken along the line 4—4 of FIG. 3.
Figure 5:
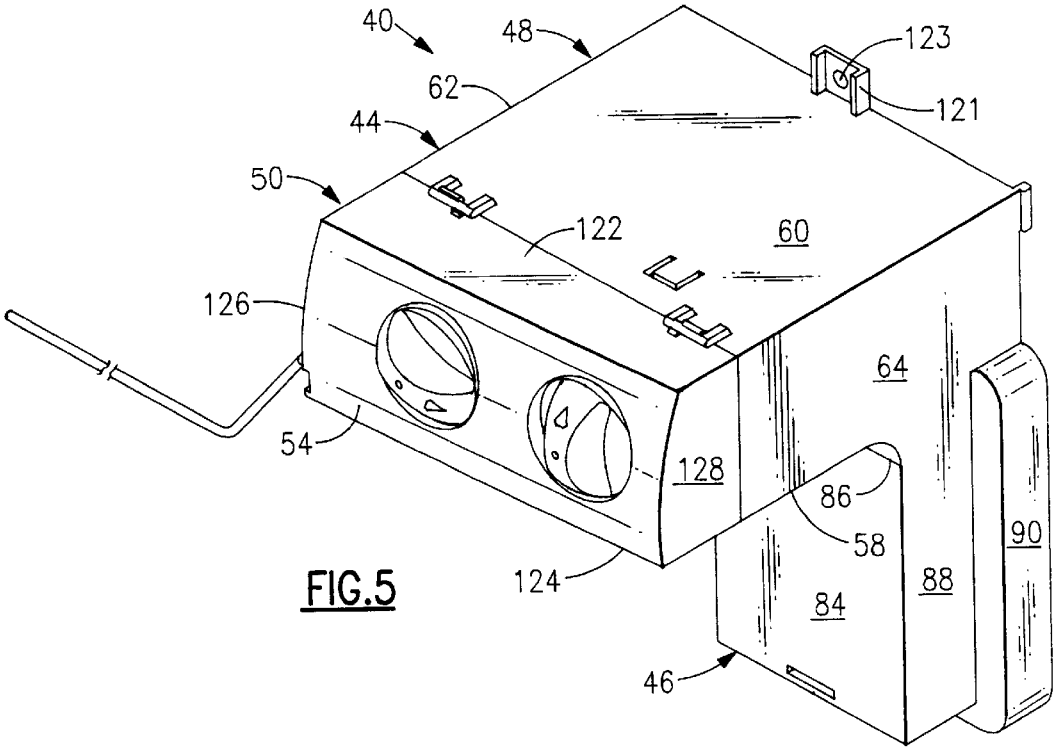
FIG. 5 is an enlarged perspective view of a mechanical version of the control box of the present invention.

It should be understood that numerous electrical wires are interconnected with the control components of the control box and with the capacitor 110. These components extend through the open back of the control box housing 44, and when the control box is mounted to the metal partition 26, as illustrated in FIGS. 3 and 4, the wires pass through an opening 120 formed in the metal partition to pass into the outside section 14 of the air conditioning unit where the fan, motor and compressor are located. Attachment of the control box to the partition is carried out by means of a pair of mounting lugs 121, the first extending upwardly from the top wall 60 of the horizontal section 48, and the second extending downwardly from the strain relief guide wall 102 forming part of the bottom of the vertical section 46. A pair of suitable threaded fasteners (not shown) pass through openings 123 in the lugs and are threaded into mating opening provided in the sheet metal partition 42 with the control box attached to the partition wall 42, a dimple 125 punched through the wall 42 from the back side is caused to contact the capacitor at 127 to thereby establish a ground connection therebetween.

Figure 10:
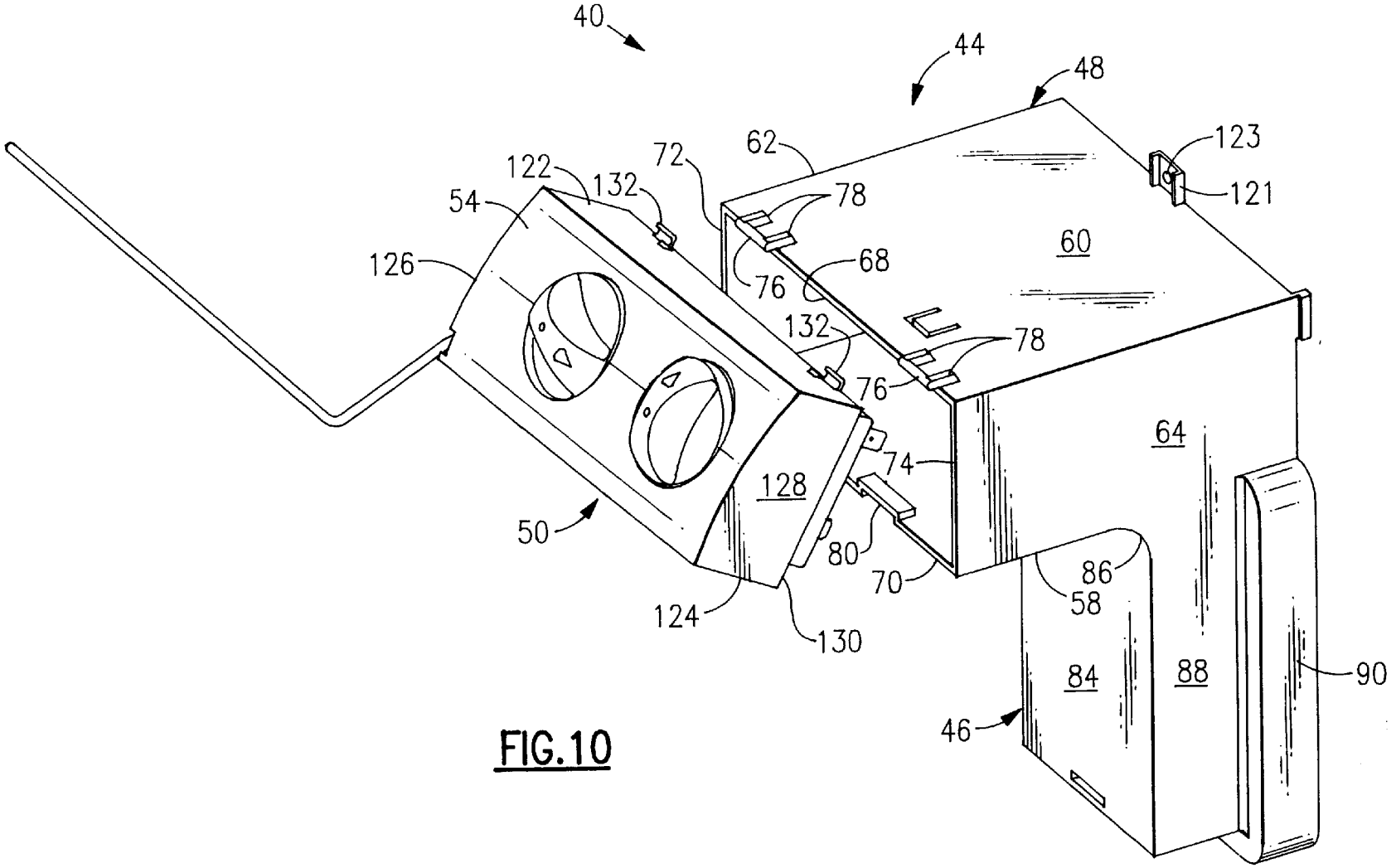
FIG. 10 is a partially exploded view of the control box illustrated in FIG. 5.

As indicated above, with the exception of the front walls 54 and 56, respectively, the electromechanical control panel section 50 and the electronic control panel section 52 are identical and, accordingly, will be described as such with common reference numerals applied to common components, as illustrated in the drawings. Each of the control panel sections 50 and 52 includes a substantially planar top 122, a substantially planar bottom 124 and left and right-hand ends 126 and 128, respectively. Each of the walls 122, 124, 126 and 128 defines a rearwardly facing edge, which together cooperate to define a rectangular peripheral opening which is identical to the forwardly facing opening defined by the horizontal section 48 of the control box housing by the edges 68, 70, 72 and 74. These rearwardly facing edges are collectively identified by the reference numeral 130. Located adjacent the rear edge of the top wall 122 are a pair of curved, forwardly facing hinge elements 132, as best seen in FIG. 10, which are adapted to engage the horizontally extending hinge pins 76 carried on the top wall 60 of the horizontal section 48. The control box section is illustrated with the hinges 132 engaged with the pins 76 in FIG. 11.

Located in the bottom wall 124 of the control panel housings 50, 52, as best seen in FIG. 11, is a rearwardly extending latch element 134, which includes a flexible section 136 and a latching head 138. The latch head is adapted to engage the horizontally extending latch bar 80 formed in the bottom wall 58 of the horizontal section and to flex downwardly upon such engagement as a result of flexing of the flex section 136 to thereby allow the latch head 138 to move to a latching position behind the latch bar 80, as illustrated in FIG. 9, to thereby securely attach the control panels 50, 52 to the horizontal section 48 of the control box housing 44.

Looking now at the electromechanical control panel 50, as best seen in FIGS. 4 and 7, the front wall 54 is provided with a pair of circular recesses 140, each of which has an opening 142 therein, which communicates with the interior of the control panel 50. Mounted within the control panel 50 on appropriate mounting conformations are a function switch 144 and a thermostat 146, each having control shafts 148 and 150 of the switch and thermostat, respectively, which extend through the openings 142 and are adapted to receive appropriate control knobs 152 and 154 thereon. A thermostat sensor 156 extends from the thermostat and is adapted to having its sensing end 158 positioned in the air flow entering the evaporator, as is conventional.

The front wall 56 of the electronic control panel 52, as best seen in FIGS. 8 and 9, comprises a series of cantilever mounted flexible elements 160, which are adapted to transfer a tactile or touch input on an outer surface 162 thereof through an actuating element on the other side thereof to appropriate pressure sensitive mechanisms 168 carried on an electronic circuit board 170 mounted behind the front wall 56 within the interior of the electronic control panel 52. A second printed circuit board 172 is adapted to be received in a horizontal orientation with opposite edges 178 and 180 thereof engaged in a drawer-like fashion in parallel guides 182 formed in the upper inner sides of the side walls 62 and 64 of the horizontal section 48, as shown in FIG. 4.

In both electromechanical and electronic embodiments, appropriate electrically wiring interconnects the control components. Such wiring is not illustrated in the drawing figures, except as illustrated in FIG. 9, to simplify illustration of the invention.

What is claimed is:

1. A control box for an air conditioner, which is configured to contain control components and a capacitor, wherein the improvement comprises:

a housing having an inverted L-shape, said housing defining a substantially vertical section and a substantially horizontal section;

said horizontal section having an open front defined by a plurality of peripherally extending edges, one or more of said edges having attachment structure formed thereon;

a control panel section for housing said control components, said control panel section having an open back defined by a plurality of peripherally extending edges, said edges being configured to engage said edges of said horizontal section, and having attachment structure formed thereon, which is configured to cooperate with said attachment structure of said horizontal section to thereby attach said control panel section to said horizontal section.

2. The control box of claim 1 wherein said control components are electromechanical, and comprise a function switch and a thermostat, and, wherein said control panel section comprises an open back box defining an interior and having a front wall, said front wall having at least two through openings formed therein, each of said function switch and said thermostat having a control shaft, and means associated therewith for mounting said switch and said thermostat with said interior with said control shafts extending through one of said openings.

3. The control box of claim 2 wherein said vertical section comprises a substantially rectangular box having an open back, which is surrounded by a plurality of peripherally extending rearwardly facing edges;

said box of said vertical section comprising mounting structure formed therein for receiving and supporting a capacitor therein in a snap-fit relationship.

4. The control box of claim 1 wherein said control components are electronic and comprise at least one printed circuit board which is configured to receive TACTILE control inputs; and wherein said control panel section comprises an open back box defining an interior and having a front wall, said front wall having a plurality of flexible elements associated therewith, each of said flexible elements having a contact surface substantially coplanar with said front wall and an actuating element extending into the interior of said open back box;

and further comprising means for supporting said at least one printed circuit board within the interior of said open back box in operational proximity to said actuating elements of said flexible elements;

whereby upon manual depression of said contact surface of said flexible elements, said actuating elements will engage and operate TACTILE control input elements of said printed circuit board.

5. The control box of claim 4 wherein said vertical section comprises a substantially rectangular box having an open back, which is surrounded by a plurality of peripherally extending rearwardly facing edges;

said box of said vertical section comprising mounting structure formed therein for receiving and supporting a capacitor therein in a snap-fit relationship.

* * * * *